United States Patent [19]

Matsuda et al.

[11] 4,047,402

[45] Sept. 13, 1977

[54] REINFORCEMENT FOR SLIDE FASTENERS

[75] Inventors: Yoshio Matsuda, Nyuzen; Yoshinori Fujisaki, Kurobe, both of Japan

[73] Assignee: Yoshida Kogyo Kabushiki Kaisha, Japan

[21] Appl. No.: 636,540

[22] Filed: Dec. 1, 1975

[30] Foreign Application Priority Data

Dec. 3, 1974 Japan ..... 49-147151[U]

[51] Int. Cl.[2] ..... D04B 21/00

[52] U.S. Cl. ..... 66/195; 66/192

[58] Field of Search ..... 66/190, 192, 193, 195, 66/87; 24/205.1 C, 205.16 C; 139/384 B

[56] References Cited

U.S. PATENT DOCUMENTS

| | | | |
|---|---|---|---|
| 1,716,843 | 6/1929 | Townsend | 66/192 |
| 1,734,165 | 11/1929 | French | 139/384 B |
| 1,794,159 | 2/1931 | Dinsmore | 139/384 |
| 2,338,945 | 1/1944 | Just et al. | 66/195 |
| 2,607,715 | 8/1952 | Waldes | 139/384 B |
| 3,068,908 | 12/1962 | Firing | 139/384 B |
| 3,926,017 | 12/1975 | Matsuda et al. | 66/195 |

FOREIGN PATENT DOCUMENTS

| | | | |
|---|---|---|---|
| 718,029 | 1/1932 | France | 66/190 |
| 1,199,511 | 7/1970 | United Kingdom | 66/195 |

*Primary Examiner*—Ronald Feldbaum
*Attorney, Agent, or Firm*—Bucknam and Archer

[57] ABSTRACT

Two or more warp-knitted members of a tubular or cylindrical shape are interconnected by a connecting thread to provide reinforcement to be inserted longitudinally in a row of helically coiled fastener elements. The tubular warp-knitted members may be wrapped around core members. A choice is available of diameters of the warp-knitted members so as to be compatible with the particular shapes and contours of given fastener elements. A plurality of warp-knitted members are interconnected in such a fashion that the resulting reinforcement can be adapted for securing a relatively large-size fastener element onto the tape.

3 Claims, 8 Drawing Figures

REINFORCEMENT FOR SLIDE FASTENERS

BACKGROUND OF THE INVENTION

This invention relates generally to slide fasteners and, more particularly to a reinforcement inserted longitudinally in a row of helically coiled interlocking elements mounted on a tape edge of the slide fastener.

There have heretofore been known various slide fastener reinforcements having a warp-knitted structure. Typical prior reinforcements of this type comprise a warp-knitted fabric having wales on its one surface. The reinforcements can be adapted for use with fastener elements of different sizes since the wales of the knit fabric can be varied in width conveniently be selecting various knitting structures or by using knitting yarns of various deniers. However, since it is difficult to increase the height of the wales simply by changing the knitting structures or the knitting yarns, the prior art reinforcements have a drawback in that they are not acceptable for relatively large coil or meandering fastener elements of the type which has a pair of upper and lower legs with a relatively large gap or space defined therebetween.

SUMMARY OF THE INVENTION

With the prior art deficiencies in mind, it is a primary object of the invention to provide an improved reinforcement for a slide fastener which can be used for various forms of fastener elements of a coil or meander type, and which has particular utility for relatively large fastener elements.

Another object of the invention is to provide a reinforcement capable of maintaining the desired flexibility of finished slide fasteners per se over prolonged periods of time.

According to the invention, there are provided two or more warp-knitted members of a tubular or cylindrical shape, which members are interconnected by a connecting thread. The tubular warp-knitted members may be wrapped around core members. A choice is available of diameters of the warp-knitted members are interconnected in such a fashion that the resulting reinforcement can be adapted for securing a relatively large-size fastener element onto the tape.

The invention will be better understood from the following description taken in conjunction with the accompanying drawing which illustrates preferred embodiments which the invention may assume in practice and in which like reference numerals refer to like or corresponding parts throughout the different views.

DETAILED DESCRIPTION OF THE PREFERRED EMBODIMENTS

Figure 1:
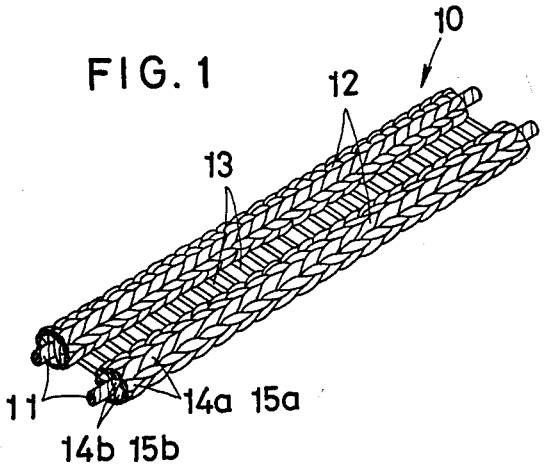
FIG. 1 is a perspective view of a reinforcement provided in accordance with the invention.

In FIG. 1, there is shown a tape edge reinforcement 10 embodying the invention and comprising a pair of core members 11 each in the form of twisted or stranded cotton or synthetic fiber yarn, a plastic filament, a metallic wire or the like, a pair of tubular, warp-knitted members 12 wrapped around the core members 11, and a connecting thread 13 interconnecting the warp-knitted members 12 together.

Each tubular member 12 has a warp-knitted structure which is formed by a double needle in a knitting machine such as a double Raschel or a double tricot knitting machine and in which two sets of threads 14 and 15 are arranged so that needle loops **14*a* and 15*a* will be fastened to and around the core member 11 by sinker loops 14*b* and 15*b*, and the needle loops 14*a* and 15*a* will appear on the peripheral surfaces of the tubular members 12. More specifically, this warp-knitted structure of the tubular members 12 is characterized by the arrangement in which the front and back sinker loops 14*b*, 15*b* extend warpwise in diagonally crisscrossed relation to each other and urge the respective needle loops 14*a*, 15*a* to clinch centrally around the core member 11 as the warp-knitting progresses. This may be accomplished by selecting the mode of operation of the machine in which the front and back guide bars are shogged symmetrically in opposite directions so that the two guide bar threads form alternate underlaps and overlaps interconnected with the respective needle loops 14*a* and 15*a* and fastening the latter centrally to and around the core member 11 which is laid in as a warp thread where no shogging takes place. A typical example of design pattern of this warp-knitted structure is illustrated in FIG. 2, wherein the needle loops 14*a* and 15*a*** are shown to be in the form of closed laps, but these may be partly or wholly open laps.

Figure 2:
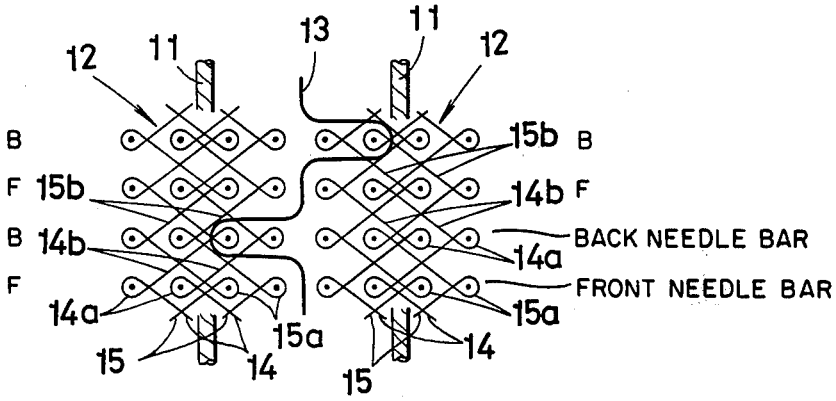
FIG. 2 is a schematic diagram illustrating a typical example of warp-knit design employed according to the invention.

In FIG. 2, those loops formed by a back needle bar are marked by the letter "B," and those loops formed by a front needle bar are marked by the letter "F." Four guide bars are provided for the threads 14, threads 15, core members 11 and connecting thread 13.

As shown in FIG. 2, two warp-knitted members 12 are interconnected transversely in parallel, spaced-apart relation by means of the connecting thread 13 which is laid in weftwise, or alternatively, is knitted with the warp-knitted members 12. The reinforcement 10 may include two or more members 12 of different diameters as will be described below.

Figure 3A:
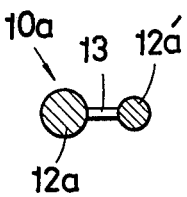
FIGS. 3A through 3C are schematic, transverse cross-sectional views each showing a modified form of reinforcement according to the invention.
Figure 3B:
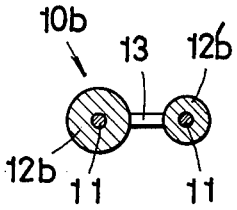
Figure 3C:
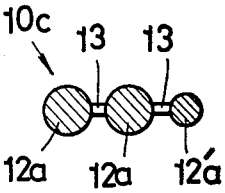

FIGS. 3A through 3C show some preferred modified forms of reinforcement provided in accordance with the invention. A reinforcement **10*a* shown in FIG. 3A, comprises a warp-knitted member 12*a* of a large diameter and a warp-knitted member 12*a*' of a smaller diameter, both members being cylindrical in shape and having the core member 11 excluded therefrom. The cylindrical members 12*a* and 12*a*' are interconnected by the connecting thread 13. In FIG. 3B, a reinforcement 10*b* comprises a large-diameter tubular member 12*b* wrapped around the core member 11 and a small-diameter tubular member 12*b*' wrapped around the core member 11, both members being interconnected by the connecting thread 13. A reinforcement 10*c* shown in FIG. 3C is formed with an additional large-diameter warp-knitted member 12*a* combined with the reinforcement 10*a* of FIG. 3A. The added member 12*a* is likewise connected to the reinforcement 10***a* by a connecting thread 13.

Figure 4A:
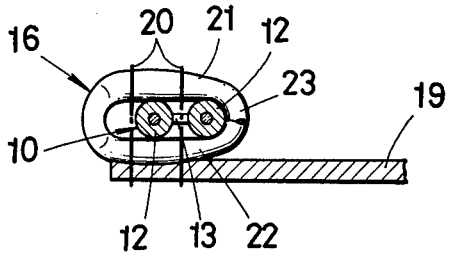
FIGS. 4A through 4C are transverse cross-sectional views illustrating various forms of reinforcement mounted in helically coiled fastener elements of corresponding shapes and sizes.
Figure 4B:
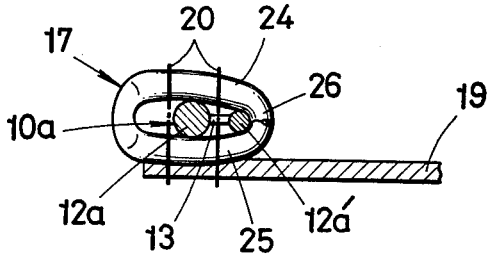
Figure 4C:
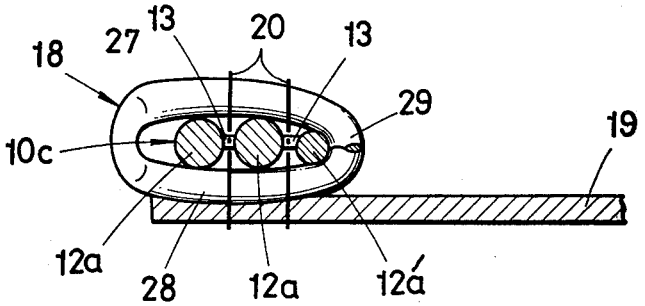

FIGS. 4A through 4C illustrate the reinforcements inserted through a longitudinally extending space defined in continuous formation of fastener elements, which are each in the form for example of a helical coil, and secured with the fastener elements to one side of a carrier tape 19 by means for example of sewing threads 20. The reinforcements of this invention have particular utility for widely varied shapes and sizes of fastener elements because they are constituted by a wide selection of warp-knitted members. For example, as shown in FIG. 4A, the reinforcement 10 shown in FIG. 1 is used with the fastener element 16 having a pair of parallel legs 21, 22 connected by a connecting portion 23. In FIG. 4B, the reinforcement 10*a* is inserted in the fastener element 17 having a pair of legs 24, 25 which converge toward a connecting portion 26. The reinforcement 10*c* shown in FIG. 3C is adapted for the fastener element 19 which is relatively large and has a pair of curved legs 27, 28 connected by a connecting portion 29, as shown in FIG. 4C. These reinforcements 10, 10*a* and 10*c* have their warp-knitted members disposed for partial contact with the element legs and, preferably, have their outermost members 12, 12*a*′, and 12*a*′ engaged at their outer peripheral surfaces with the connecting portions 23, 26 and 29, respectively to stabilize the position of the inserted warp-knitted members. The sewing threads 20 may be arranged to pass between the adjacent warp-knitted members in the fastener elements and, as shown in FIGS. 4A and 4B, extend across the innermost warp-knitted members.

Advantageously, the reinforcements according to the invention can be changed in diameter and be used for various forms of fastener elements since a choice is available of diameters of the warp-knitted members by using knitting yarns of various deniers or core members of various diameters to adapt the members to various sizes and shapes of the spaces in the fastener elements.

Furthermore, the reinforcement including at least two warp-knitting members which are high in density and stable in structure can, when disposed within the space in the fastener elements, stabilize the position and posture of the fastener elements over extended periods of use of the slide fastener. Because the reinforcements are held only in partial contact with the coiled fastener elements, and the sewing threads 13 are prevented from passing through the warp-knitted members, the reinforcements according to the invention can retain the desired flexibility of the resultant slide fastener. In addition, the reinforcement having the round peripheral surfaces allows sewing needles to pass the fastener tape along predetermined positions between the adjacent warp-knitted members.

While certain preferred embodiments of the invention have been described in detail, it is to be understood that various changes and modifications may be made therein without departing from the scope of the appended claims.

What is claimed is:

1. A reinforcement for a slide fastener comprising a plurality of cylindrical, warp-knitted members having needle loops and sinker loops interconnected therewith, said sinker loops extending in diagonally criss-crossed relation to each other and alternately over and under said needle loops to define a plurality of warp-knitted members each having a generally tubular knitted configuration, and a connecting thread laid in weftwise to interconnect said plurality of warp-knitted members transversely in parallel, spaced-apart relation to each other.

2. A reinforcement as defined in claim 1, including a core member disposed centrally in each of said warp-knitted members and secured in position by said sinker loops.

3. A reinforcement as defined in claim 1, wherein some of said plurality of cylindrical, warp-knitted members are smaller in diameter than the others.

* * * * *